US007398788B2

(12) United States Patent
DeHart

(10) Patent No.: US 7,398,788 B2
(45) Date of Patent: Jul. 15, 2008

(54) TABLE-DISHWASHER APPARATUS PARTICULARLY ADAPTED FOR USE BY THE HANDICAPPED

(76) Inventor: Harold F. DeHart, 5512 Redwood Rd., Durham, NC (US) 27704

( * ) Notice: Subject to any disclaimer, the term of this patent is extended or adjusted under 35 U.S.C. 154(b) by 760 days.

(21) Appl. No.: 11/017,301

(22) Filed: Dec. 20, 2004

(65) Prior Publication Data

US 2005/0098197 A1 May 12, 2005

Related U.S. Application Data

(63) Continuation-in-part of application No. 10/378,511, filed on Mar. 3, 2003, now Pat. No. 6,832,618.

(51) Int. Cl.
*B08B 3/02* (2006.01)

(52) U.S. Cl. ..... 134/115 R; 134/200; 134/301; 312/228

(58) Field of Classification Search ..... 134/115 R, 134/200, 201; 312/228
See application file for complete search history.

(56) References Cited

U.S. PATENT DOCUMENTS

| | | | |
|---|---|---|---|
| 1,373,506 | A | 4/1921 | Hoyt |
| 3,177,766 | A | 4/1965 | Ray |
| 3,961,984 | A | 6/1976 | Torressen |
| 4,146,405 | A | 3/1979 | Timmer et al. |
| 4,739,781 | A | 4/1988 | Casoli |

OTHER PUBLICATIONS

All Pertinent Art Cited on 1449.*

"A Better Mousetrap is Just the Start" Vicki Lee Parker, *The News and Observer*. Jun. 15, 2003 pp. 1E and 12E.

"Dining Table with Integral Dish Washer" Promotional Brochure, Harold F. DeHart, 2002.

"The Self-Cleaning Dinner Table" Bruce Grierson, *The New York Times*. Dec. 15, 2002 p. 120.

"Kitchen Convenience Marches On: A Dishwasher Built Into the Table, an Online Fridge and A Stirring Arm" Sabra Chartrand. *The New York Times*. Jul. 15, 2002, p. C2.

"Durham Man Hoping to Clean Up in Homes" Angela D. Forest, *The Durham Herald-Sun*. Nov. 12, 2002, pp. A1-A2.

"Week's End" David Hughey, William E.N. Hawkins, William R. Stagg, and James R. Wilson. *The Durham Herald-Sun*. Nov. 16, 2002, p. A24.

www.au-dine.com Oct. 25, 2004.

* cited by examiner

*Primary Examiner*—Frankie L Stinson
(74) *Attorney, Agent, or Firm*—Olive & Olive, P.A.

(57) ABSTRACT

The invention provides a dining table including integral dishwasher units. An access cover providing access to the dishwasher is provided in the dining surface and is adapted for being recessed within portions of the dining surface while the user is dining. A perforate chute extending from below the dining surface into the dishwasher is used for placing and retrieving dishes and for storing dishes during washing. A pot washer is used to wash pots and other large utensils in a separate washer. The pot washer includes a pot washer basket which is slidably mounted on a fixed support in such a way as to be accessible through doors from either side of the table. A switch arrangement prevents the potwasher from being used except when the doors are closed. The control panel as well as compartments for condiments and the like are mounted in such a way as to be accessible to the handicapped.

19 Claims, 11 Drawing Sheets

TABLE-DISHWASHER APPARATUS PARTICULARLY ADAPTED FOR USE BY THE HANDICAPPED

This is a continuation-in-part of U.S. patent application Ser. No. 10/378,511, filed Mar. 3, 2003 now U.S. Pat. No. 6,832,618.

FIELD OF THE INVENTION

This invention relates to the field of table-dishwasher apparatus adapted particularly for use by the handicapped when dining.

BACKGROUND OF THE INVENTION

A relatively recent review of the prior art is to be found in applicant's prior U.S. Pat. No. 6,378,537 issued Apr. 30, 2002, as well as in Applicant's co-pending patent application Ser. No. 10/378,511 for "Dining Table with Integral Dishwasher" and anticipated to issue as U.S. Pat. No. 6,832,618 on Dec. 21, 2004. The present application for patent constitutes a continuation in part of patent application Ser. No. 10/378,511.

Reference to the prior art as described in said U.S. Pat. No. 6,378,537 and patent application Ser. No. 10/378,511, as well as the teachings of said '537 patent and '511 patent application should be regarded as being incorporated herein by reference and will not be duplicated here. The reader's attention is directed to such prior art review as being useful background for understanding the present invention that represents an improvement over the apparatus described in the aforementioned '537 patent and '511 patent application.

With the above mentioned background in mind, the present invention has for its principal object that of providing a dining table with both an integral dishwasher as well as an integral pot washer of simplified construction and arrangement and adapted to provide ease of access to its washing and storage components particularly when used by handicapped individuals. Other objects will become apparent as the description proceeds.

SUMMARY OF THE INVENTION

A dining table is provided with both an integral dishwasher as well as an integral pot washer installed beneath the dining surface. An access cover formed as a panel made as a single piece resides in an opening formed in one or both side portions of the dining surface and in an open position allows the user to place dishes into and remove dishes from a roller mounted basket forming part of the dishwasher unit located below the panel. In a closed position, the panel forms a continuation of the dining surface. The integral pot washer is installed in a location accessible to diners through door openings from either of two opposite sides of the dining surface. A switch control requires both of the pot washer doors to be closed in order for the pot washer to operate. The shape and arrangement of the table, storage compartments, control panel, sink, dishwasher and potwasher facilitate use of the table-washer apparatus of the invention by those who use it for dining and particularly for those who are handicapped.

DESCRIPTION OF THE PREFERRED EMBODIMENT

The description is first directed primarily to the subject matter of applicant's prior U.S. Pat. No. 6,378,537 and later to the specific improvements, which are the subject matter of the present invention. Much of the beginning description will necessarily repeat description of the '537 patent, whereas the later description will describe those improvements, which constitute the present invention.

Figure 1:
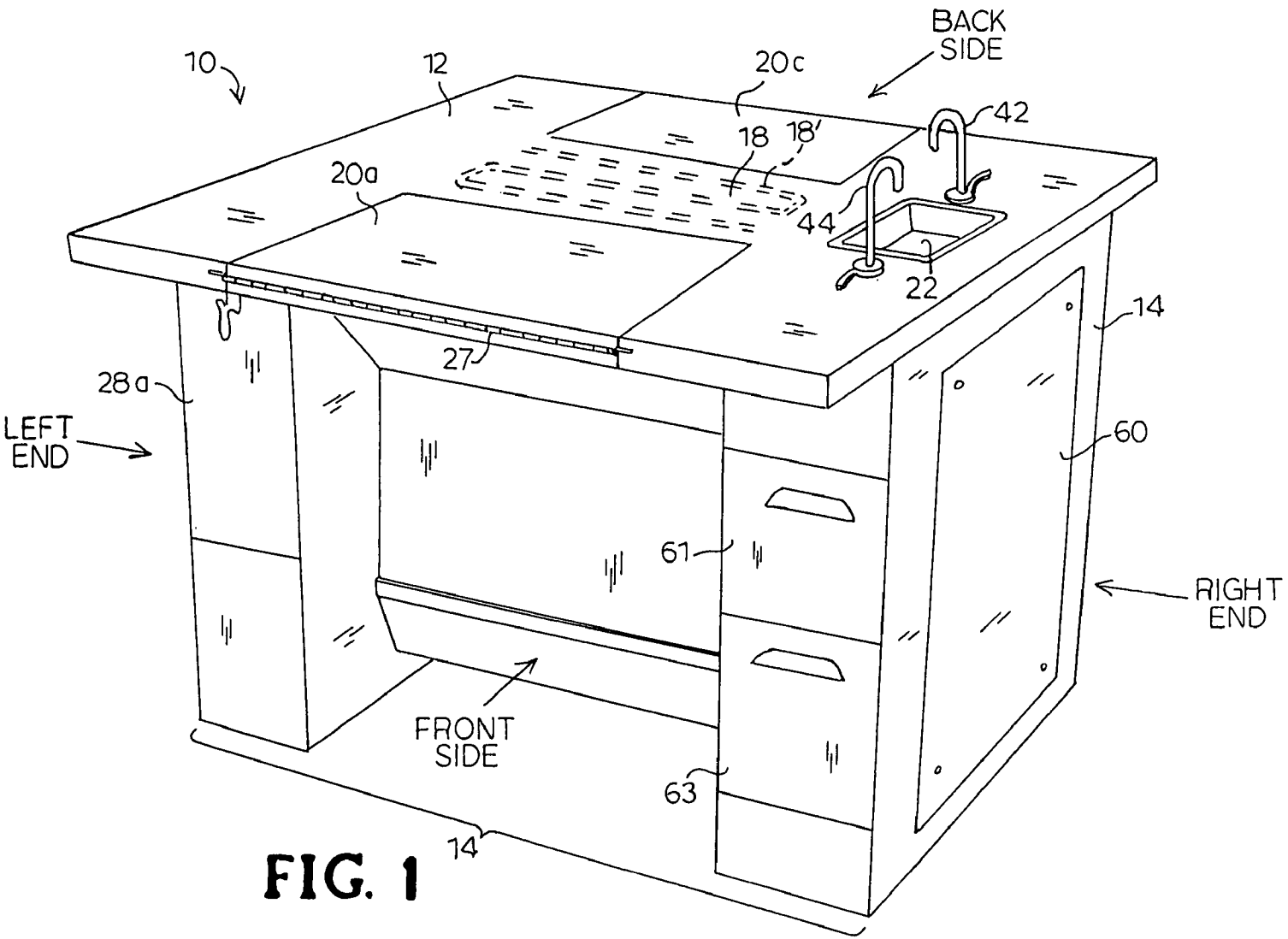
FIG. 1 is a top perspective view of the invention apparatus looking towards one side of the invention apparatus and indicating what the description refers to as the "ends" and "sides" of the support base on which the table is mounted.

In accordance with the objects disclosed above, FIG. 1 illustrates improved table 10 of the present invention including an integral dishwasher and potwasher. Table 10 is formed generally of a top portion comprised of dining surface 12 mounted on support base 14. Since the present invention was developed for reasons of aesthetics, efficiency, more sanitary eating area, and ease of use, table 10 is substantially permanently mounted in a selected location, and a water line, a waste line, and electric line (not shown) are appropriately connected to the enclosed dishwasher unit. Dining surface 12 contains sink 22 and electrical outlet 26 and a series of dials or switches 24 for operating the dishwasher and an optional warming surface 18. A heating element 18' is located beneath warming surface 18.

Figure 2:
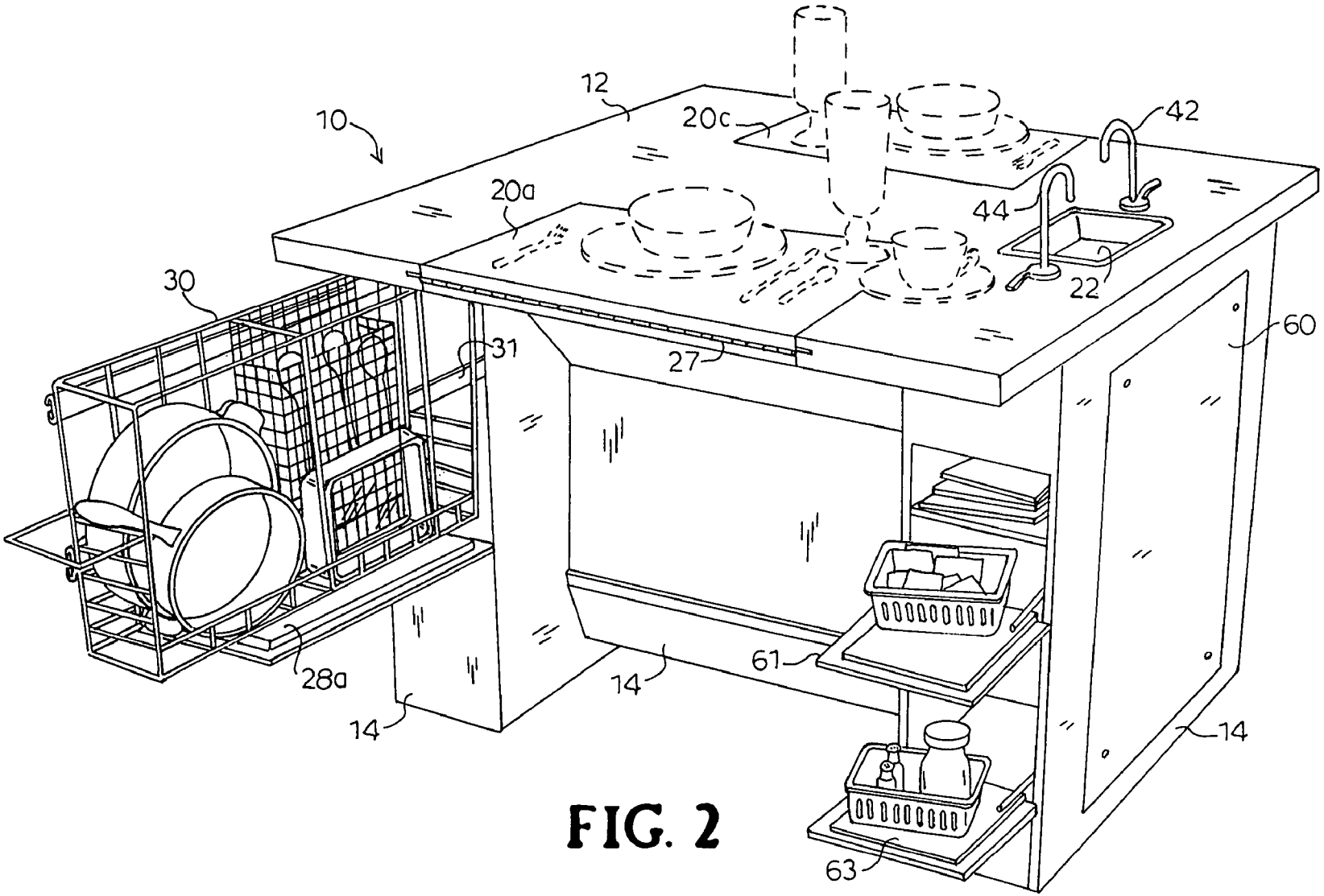
FIG. 2 is a top perspective view of the invention apparatus similar to that of FIG. 1 but with the pot washer basket extended outwardly and the storage compartment doors shown open.
Figure 3:
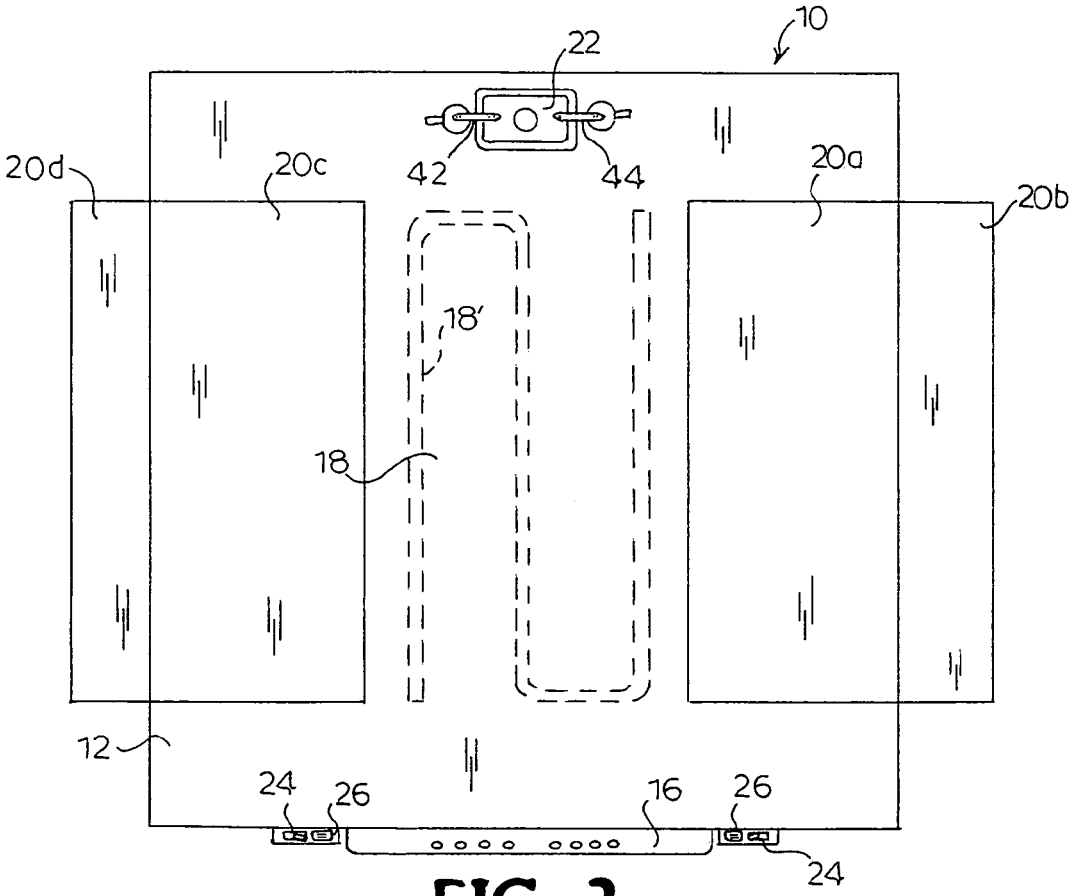
FIG. 3 is a top plan view of the invention apparatus with the access covers in their closed position and with the respective extension panels in their respective high position.
Figure 11:
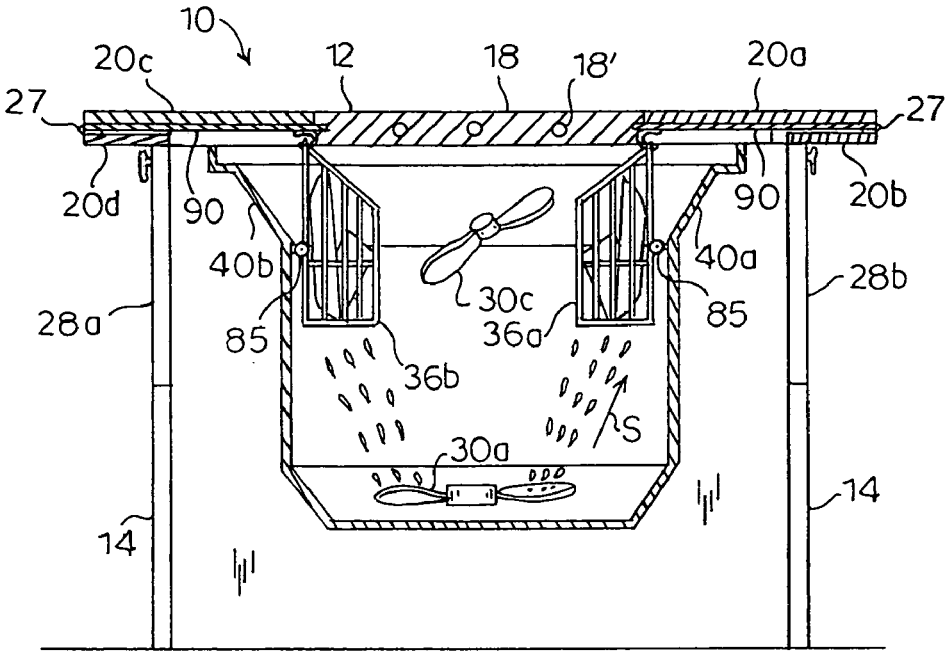
FIG. 11 is a somewhat schematic section view taken as if looking towards the left end of the apparatus of FIG. 1 with the access covers closed and the respective extension panels in their low position.
Figure 12:
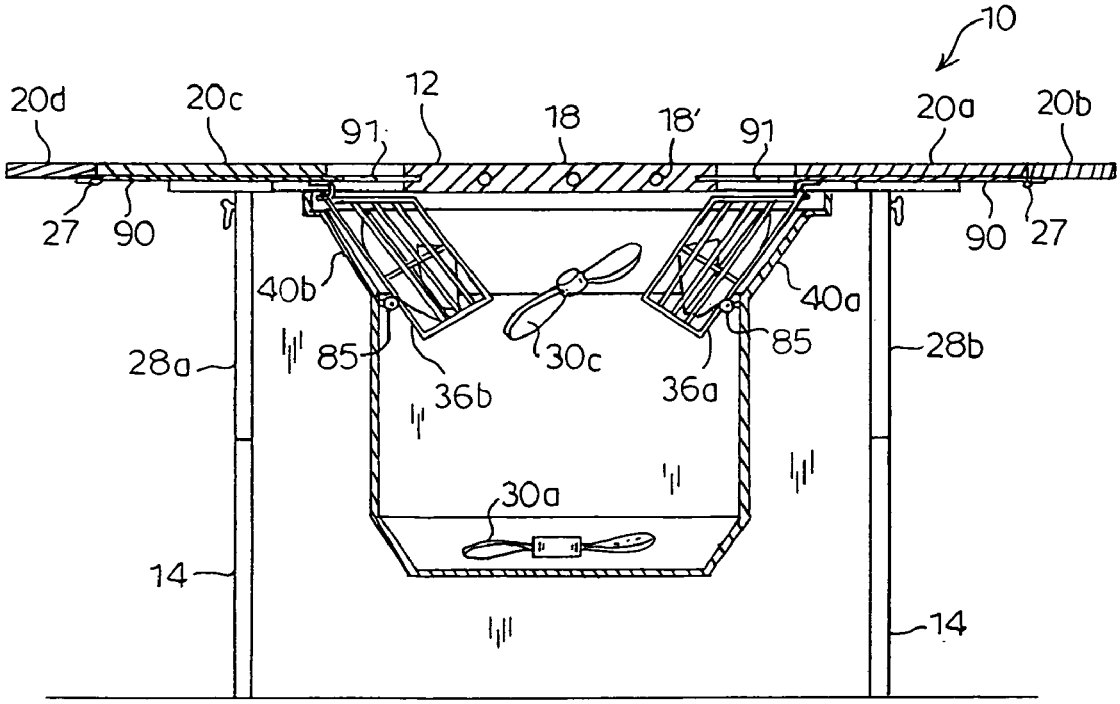
FIG. 12 is a somewhat schematic section view taken, as in FIG. 11, as if looking towards the left end of the apparatus of FIG. 1 with the access doors open and the respective extension panels in their high position.

While dining surface 12 could be configured to accommodate a single individual, dining surface 12 is illustrated in the preferred embodiment configured to accommodate at least two people. Accordingly, an access cover 20*a* is in a position suited to a first person being seated at table 10. An extension panel 20*b* illustrated by way of example as being of substantially the same thickness as that of access cover 20*a* joined by a hinge to access cover 20*a* operates in conjunction with access cover 20*a* and can be folded underneath access cover 20*a* when not in use as in FIG. 1. Also to be noted is that when access cover 20*a* is positioned, as in FIG. 1, its top surface is substantially flush with the top of dining surface 12 and is illustrated in FIG. 2 with a typical set of dishes and utensils (shown in dashed lines) placed for use. The access cover 20*a* is adapted to be positioned so as to either cover (as in FIGS. 1, 2, 3, or 11) or uncover (as in FIG. 12) the operative portion of the dishwasher below. As further explained below, one side of table 10 is fitted with an access cover 20*a* and extension panel 20*b*, and the opposite side of table 10 is fitted with a comparable access cover 20*c* and extension panel 20*d*. The respective extension panels 20*b* and 20*d* basically have two parallel positions, referred to as being high and low. The high position places their respective surfaces in the same plane as that of the dining surface 12, as shown in FIGS. 3, 12, and 16. The respective low position of extension panel 20*b* is illustrated in FIGS. 1, 2, 11, and 15. The extension panels 20*b*, 20*d* are supported, positioned, latched, and unlatched by the later-explained mechanism.

Figure 15:
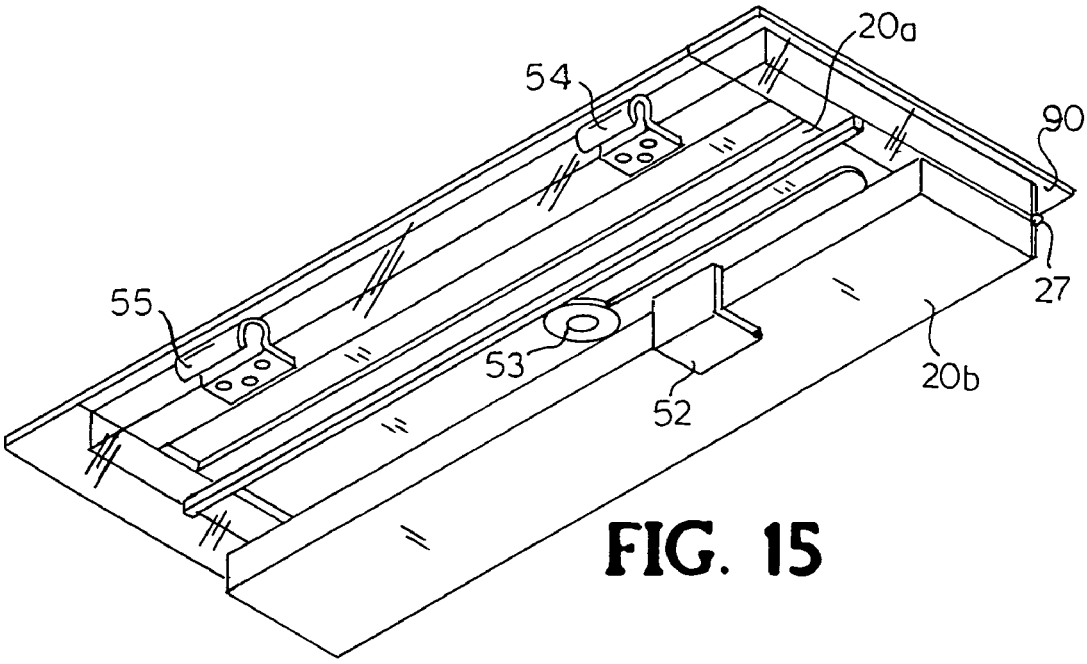
FIG. 15 is a bottom perspective view of an access cover with its respective extension panel in its low position.
Figure 16:
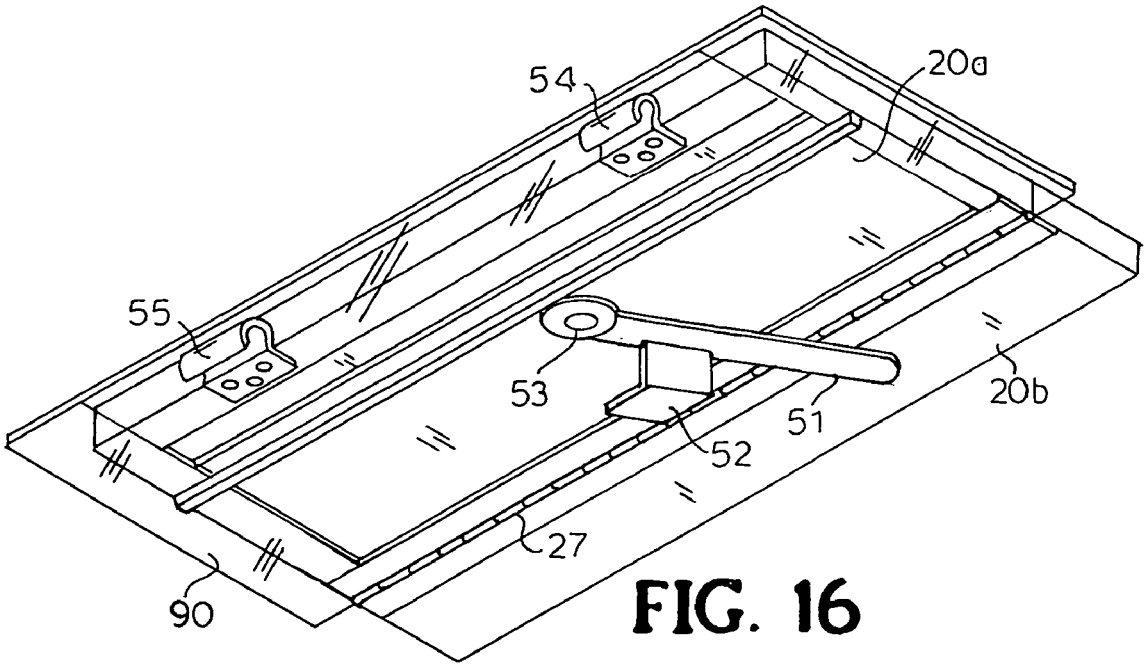
FIG. 16 is a bottom perspective view of an access cover with its respective extension panel in its high position.
Figure 19:
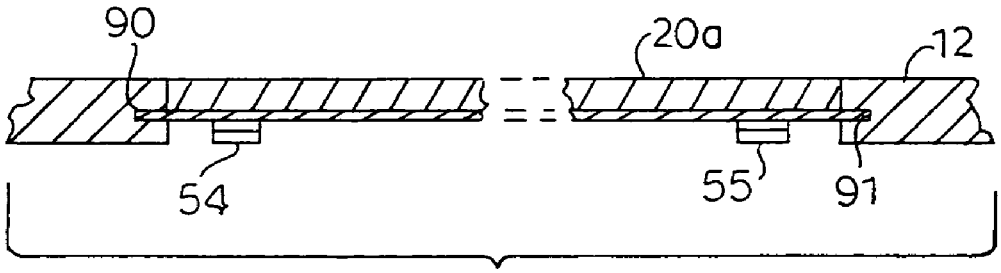
FIG. 19 is a partial cross-sectional view of an access cover as used in the apparatus of FIG. 1.

By contrast, with regard to the manner in which the extension panels 20*b*, 20*d* are supported, positioned, latched, and unlatched, the access cover 2*a* is supported by means of a flange 90 secured to access cover 20*a* as in FIGS. 15 and 16. The flange 90 fits into a groove 91 integral to table 10 as in FIG. 19. Thus, access cover 20*a* can be slid towards and away from a diner. Access cover 20*c* operates by the same principle. With this preliminary introduction to the outer and inner access covers and their operation, the description now continues with other aspects of the invention.

Figure 4:
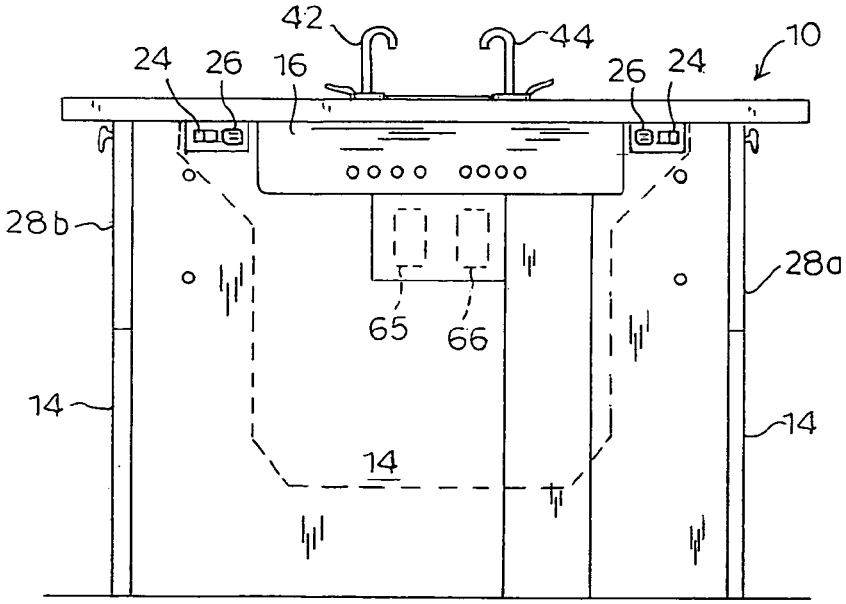
FIG. 4 is a left end view of the invention apparatus of FIG. 1.

Sink 22 is equipped with an electrically heated water spigot 42 for making instant coffee, tea or soup, in addition to the usual water connection 44. Pot insertion doors 28*a* and 28*b* are located to the left of the front side and the right of the back side (as seen in FIGS. 1 and 2) of support base 14 for placing larger cooking and serving utensils into the dishwasher unit of the invention. Here it should be noted that with respect to pot insertion doors 28*a* and 28*b* that the improvement to which the present invention relates is especially intended to include the means employed for accessing the pot washer basket 30 in a manner which permits the diner, irrespective of on which side of table 10 the diner is sitting, to load and unload items to be washed by the pot washer As best seen in FIG. 3, the apparatus with the access covers 20*a* and 20*c* in their respective closed positions shown in solid line in FIG. 3 and extension panels 20*b* and 20*d* in their respective extended positions provide additional dining surfaces. Warming surface 18, in which heating element 18' is enclosed, is located in dining surface 12, in a location between the access cover 20*a* and the opposite access cover 20*c*. Warming surface 18 is preferably of a different appearance than dining surface 12 for visibility and safety reasons. A washer control panel 16 and preferred locations for detergent reservoirs 65 and 66 are shown in FIG. 4.

Figure 5:
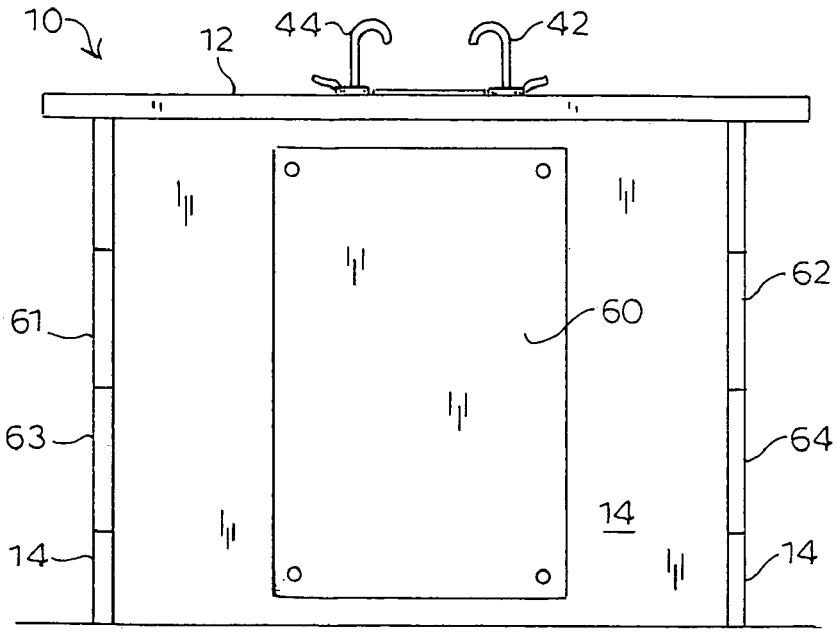
FIG. 5 is a right end view of the invention apparatus of FIG. 1.
Figure 6:
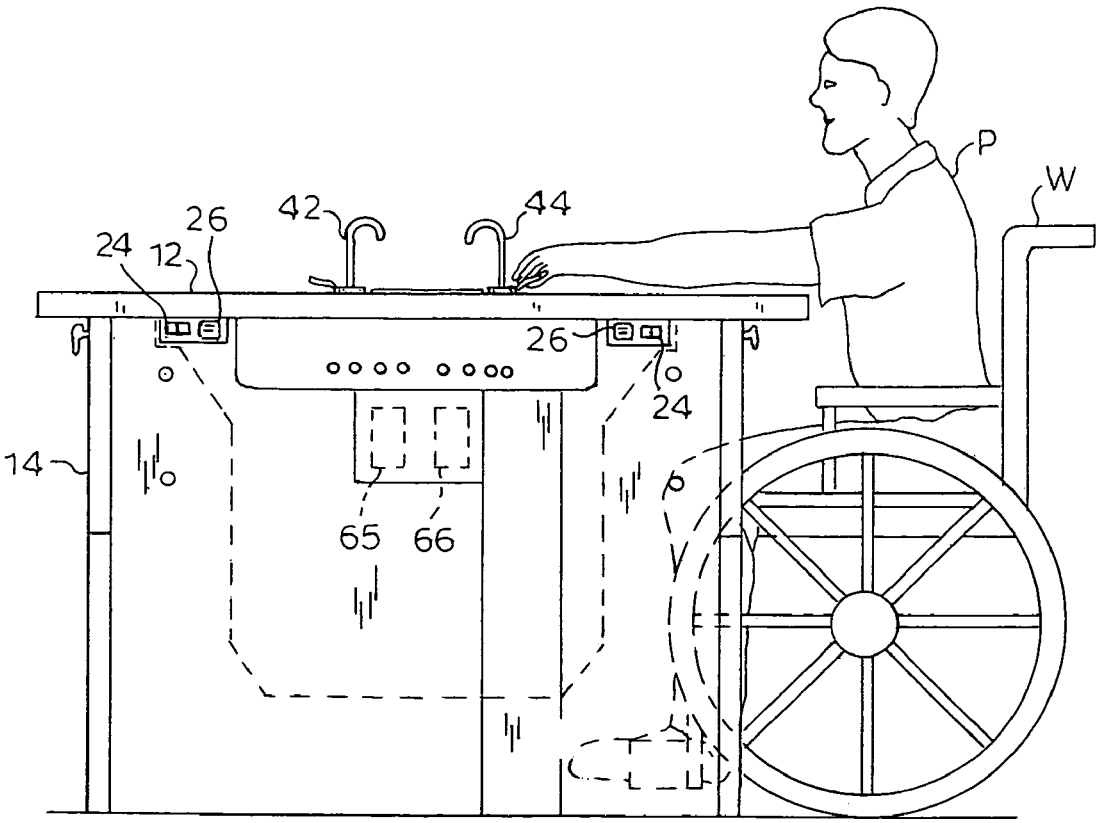
FIG. 6 is a somewhat schematic view of the left end of the apparatus of FIG. 1 illustrating use of the apparatus by a person in a wheelchair.
Figure 7:
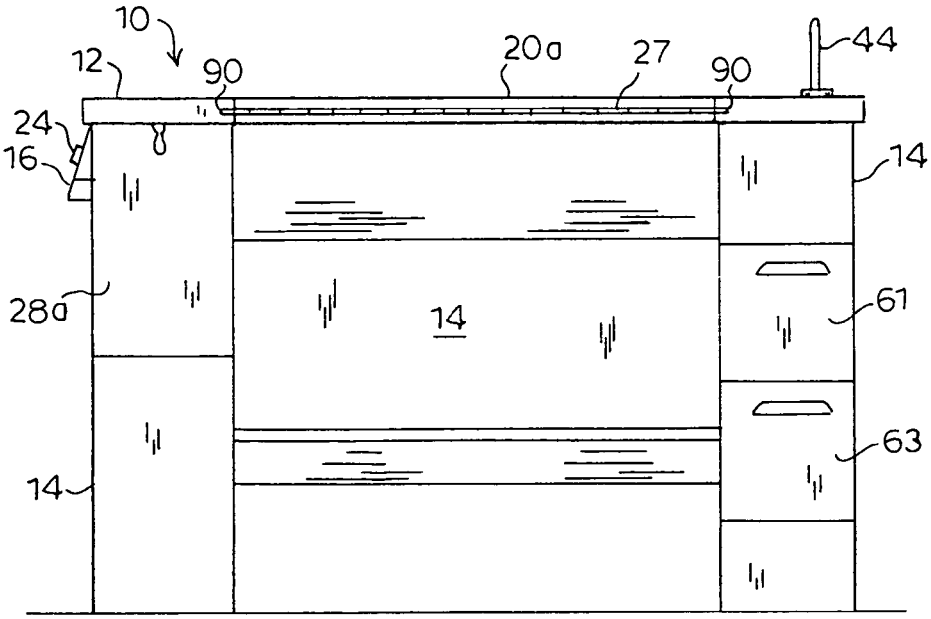
FIG. 7 is an elevation view of the front side of the apparatus of FIG. 1 with all of the doors closed.
Figure 8:
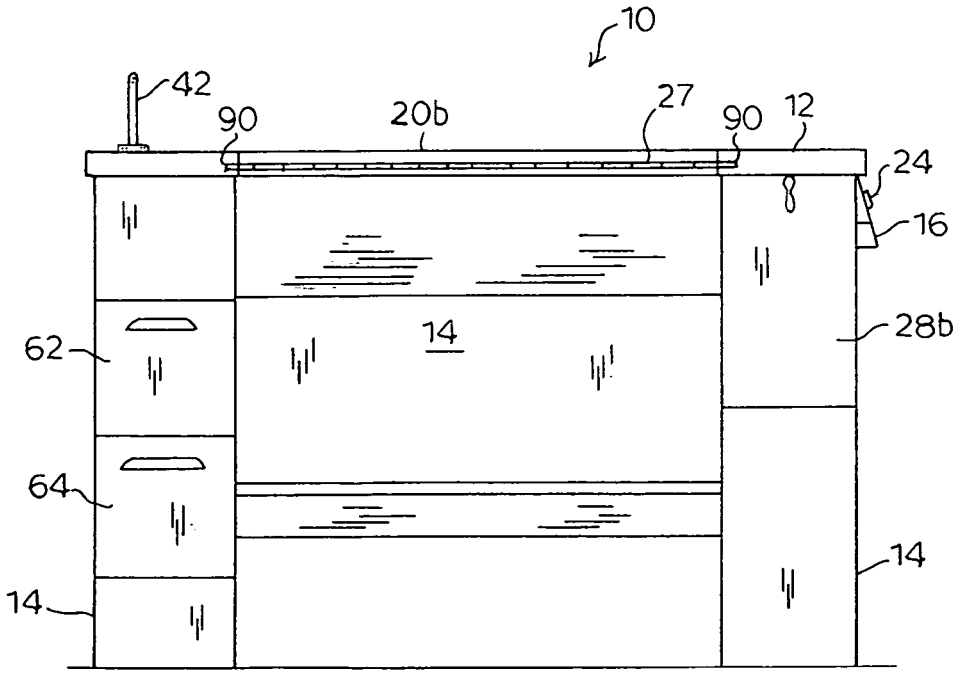
FIG. 8 is an elevation view of the back side of the apparatus of FIG. 1 with all of the doors closed.
Figure 9:
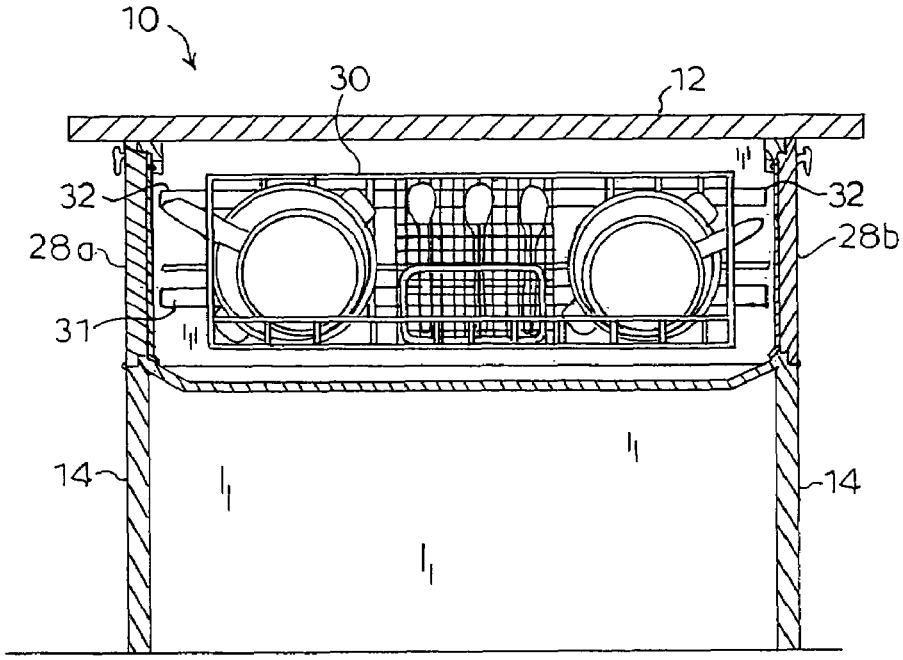
FIG. 9 is a section view of the pot washer apparatus of FIG. 1 and in a vertical plane which passes thru the pot washer assembly taken as if looking towards the left end of the apparatus of FIG. 1 with the pot insertion door closed.

FIG. 5 is a right end view of table 10 and illustrates an access door 60 that can be removed to provide maintenance on the internal mechanisms of the washer apparatus. FIG. 6 is a side elevation view of table 10 showing the ease of use of table 10 by a person P seated in a wheelchair W at the table 10. FIGS. 7 and 8 in side views of table 10 illustrate the pot washer doors 28*a* and 28*b* as well as access doors 61, 62, 63, and 64 in their respective closed positions. FIG. 9 in a section view of dining table 10 as seen in FIG. 1, illustrates the pot washer doors 28*a* and 28*b* closed and ready for a washing cycle for the pots and pans.

Figure 10:
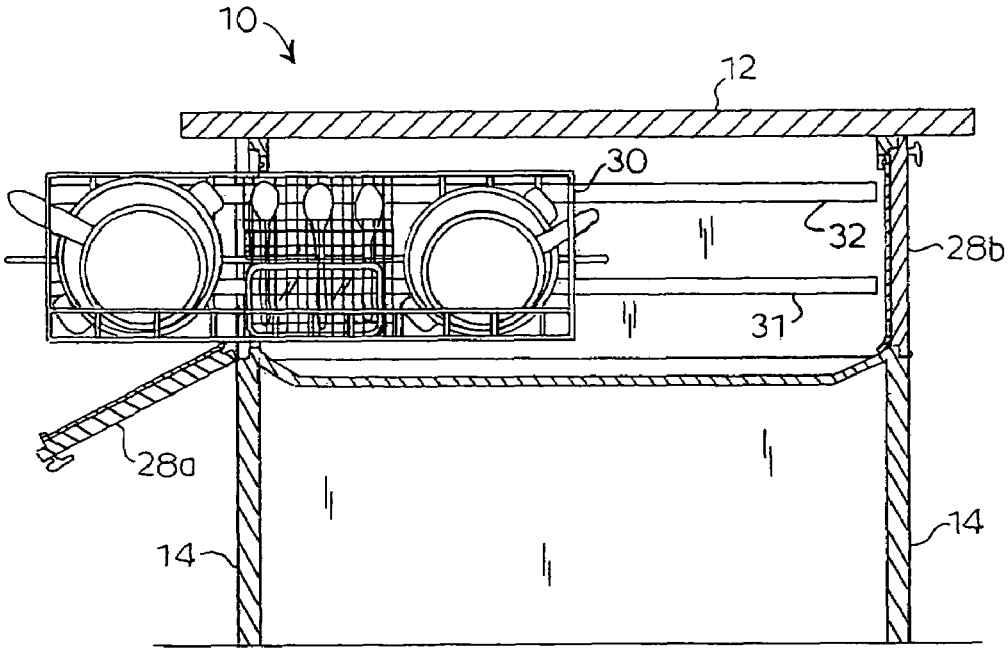
FIG. 10 is a section view of the pot washer apparatus of FIG. 1 and in a vertical plane which passes through the pot washer assembly taken as if looking towards the left end of the apparatus of FIG. 1 with the pot insertion door open.

With pot insertion door 28*a* open, as in FIG. 10, and the pot washer basket 30 pulled outwards through the opening of door 28*a* the diner is able to load or remove pots and pans into and from the pot washer basket 30. The pot washer basket 30 slides through a slidable connections along rails 31, 32 which provides a fixed support and allow the basket 30 to go through the opening of either pot insertion door 28*a* or 28*b*, so as to make basket 30 available to a diner for loading on either side of the table. Rails 31, 32 are located as seen in FIGS. 9 and 10 so as to be substantially parallel to the plane of the surface of table 10 and are laterally offset so as to be below but not directly below either of access covers 20*a* or 20*c* as indicated in FIG. 2.

Figure 18:
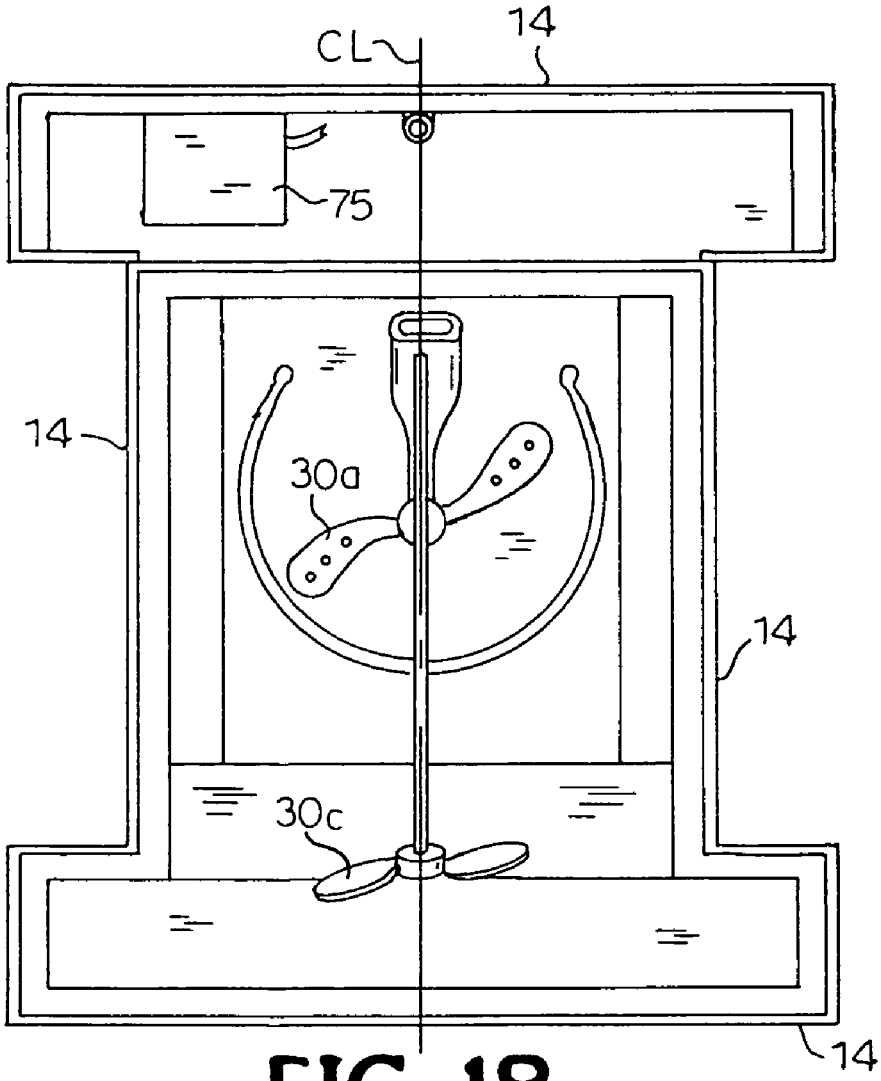
FIG. 18 is a somewhat schematic top plan view, with the top removed, illustrating the arrangement of the wash apparatus within the interior of the apparatus.

Dish-washing water-distributor arm 30*a* and pot-washing water-distributor arm 30*c* (FIGS. 11 and 12) are positioned within support base 14 in separated, horizontally and vertically spaced locations along a substantially central line CL that is parallel to the long dimension of the dining table 10 as shown in FIG. 18. Dish-washing water-distributor arm 30*a* is positioned relatively low in a center portion, substantially parallel to the plane of the dining surface 12, and potwashing water-distributor arm 30*c* is positioned relatively high and in a plane which is substantially perpendicular to the plane of dining surface 12, as best seen in FIGS. 11 and 12. When the dishwasher function operates, water distribution arm 30*a* sprays water in the direction of arrow S (FIG. 11) onto the dishes in chutes 36*a* and 36*b* when the pot washer function operates, the pot washing water distribution arm 30*c* sprays towards the basket 30 to wash pots in basket 30.

The perforate pot washer basket 30 is operatively associated with the pot washer water-distributing arm 30*c*, mounted within the support base 14 and movable along a fixed support path of restricted length established by rail 31, which extends between the side walls of support base 14 and that is located below but laterally offset from being directly below the location of the openings occupied by access covers 20*a* and 20*c*. The pot washer basket 30 is configured for receiving and holding selected pots, pans and the like in position for being washed by the pot washer water distributing arm 30*c*.

The table side portions, access cover openings, access covers, dishwasher chutes and pot washer basket are arranged so as to be accessible to the apparatus being used by a single individual sitting on either side of the support base, or by two individuals sitting on opposite sides of the support base and in either case in a manner which permits the legs of any such individual when sitting to be positioned below a selected one of the table side portions as seen in FIG. 6.

Referring next to FIGS. 11 and 12 and the perforate chutes 36*a* and 36*b*, it is to be noted that the upper back and front side panels 40*a*, 40*b* on the supportive back and front sides (as shown in FIG. 11) of support base 14 are oriented angularly to accommodate the shape of perforate chutes 36*a* and 36*b*, thus maximizing the space available for the knees of the users. Chutes 36*a* and 36*b* provide a mesh housing for dishes and utensils through which water can pass to permit thorough washing (FIG. 11). At the completion of a meal, dishes are placed in dishwashing chutes 36*a* and 36*b* for washing (FIG. 12). When all dishes are in their respective positions for washing, access covers 20*a* and/or 20*c* are closed securely. The dishwasher unit is operated to wash dishes that have been placed in chutes 36*a* and 36*b*.

As best shown in FIGS. 11 and 12, the dishwasher chutes 36*a* and 36*b* assume an angular position for loading and unloading as seen in FIG. 12. However, when in the washing position, as seen in FIG. 11, the chutes 36*a* and 36*b* assume a vertical position. It can also be observed that access doors 20*a* and 20*c*, through a pivotal connection to the respective chutes 36*a* and 36*b*, cause the angular position whenever access doors 20*a* and 20*c* are moved outwardly and permit the respective chutes 36*a* and 36*b* to assume a vertical position when access covers 20*a* and 20*c* are moved inwardly as in FIG. 11. Chutes 36*a* and 36*b* slide outwardly, see FIG. 12, as access doors 20*a* or 20*c* are opened, thus causing chutes 36*a* or 36*b* to ride on rollers 85.

Figure 13:
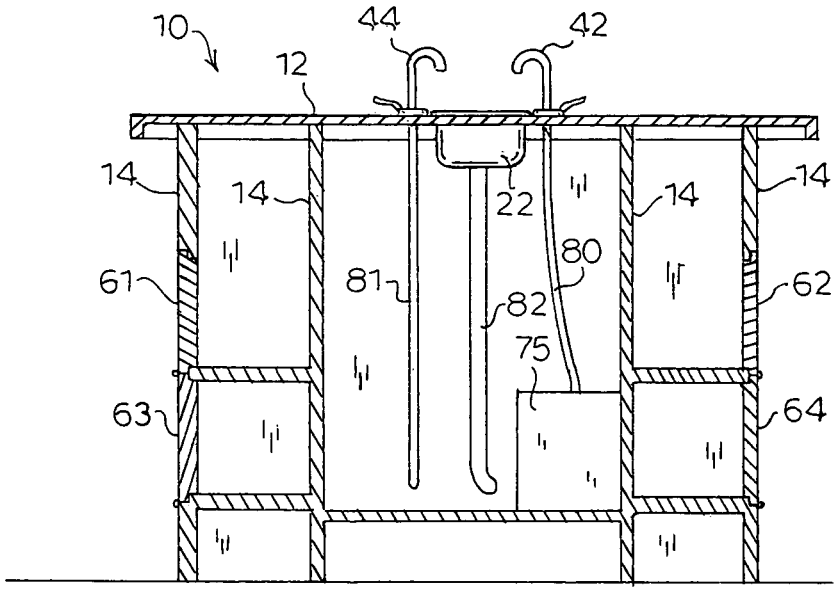
FIG. 13 is a somewhat schematic section view of the apparatus of FIG. 1 but without the washing apparatus and illustrating the housing structure with the access doors closed.
Figure 14:
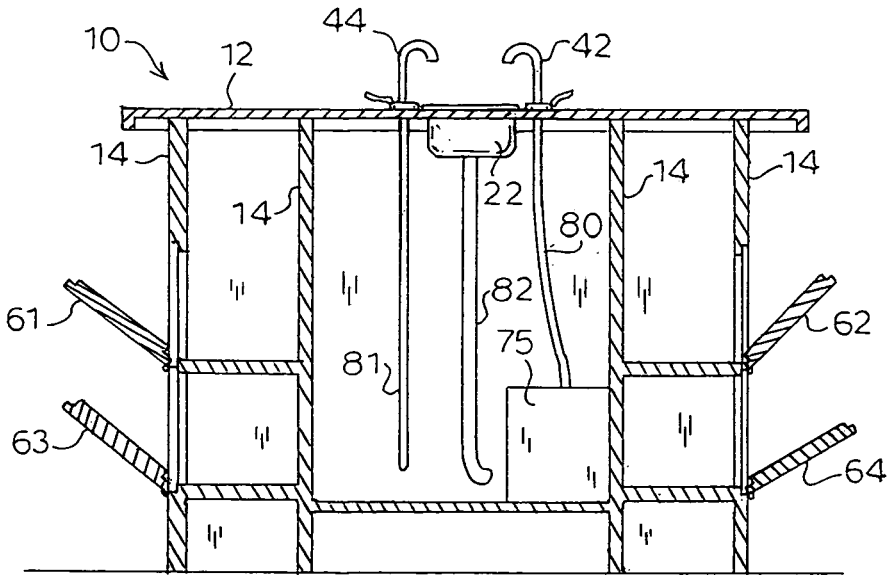
FIG. 14 is a somewhat schematic section view of the apparatus of FIG. 1 similar to that of FIG. 13 with the access doors open.

FIG. 13 shows a section view of dining table 10 as seen in FIG. 1, and optional hot water heater point of use 75, with access doors 61, 62, 63, and 64 are closed. The space within table 10 behind doors 61, 62, 63 and 64 also serves as a storage area for pots and pans when not in use. FIG. 14 shows a section view of dining table 10 with integral dishwasher as seen in FIG. 1, but with access doors 61, 62, 63 and 64 open. Also shown in FIGS. 13 and 14 are the hot water supply 80, cold water supply 81, and waste water line 82.

FIGS. 15 and 16 illustrate the operation of the access cover and extension panel support and positioning mechanism through a series of sequential positions. In FIG. 15, the extension panel 20*b* is shown in its low position, connected to access cover 20*a* by a hinge 27, and secured parallel to the underside of access cover 20*a* by a gripping means 52. When extension panel 20*b* is extended to the high position (as in FIG. 16), a relatively flat securing mechanism 51 swivels on pivot 53 to the underside of extension panel 20*b*, providing support for the dining surface above. Also shown in FIGS. 16 and 17 are the flange 90 for sliding access cover 20*a* in and out of the table 10 and hooks 54 and 55, which grip the dish washer basket 36*a* (as shown in FIGS. 11 and 12).

Figure 17:
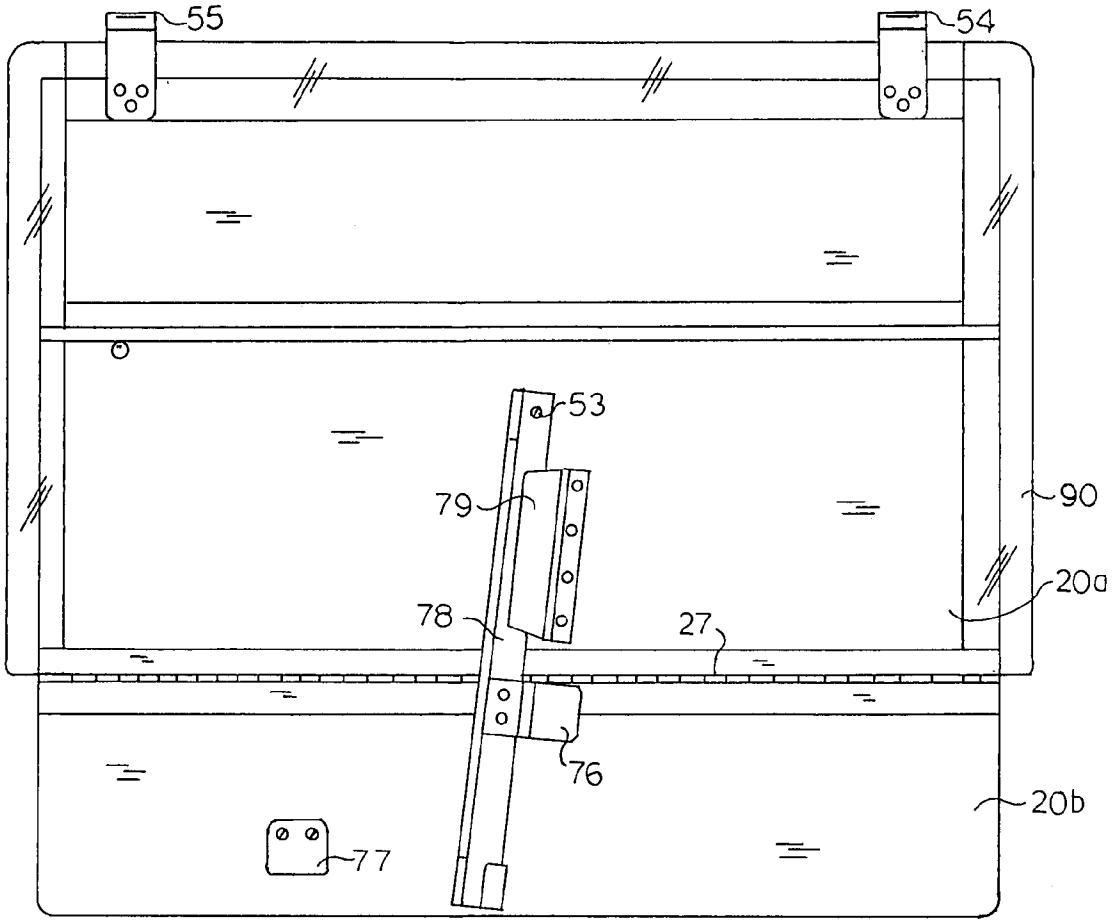
FIG. 17 is a bottom plan view of an access cover with its respective extension panel in its high position.

An alternative embodiment of access door 20*a* and extension panel 20*b* in operation with extension panel securing mechanism 78 is shown in FIG. 17. The securing mechanism 78 is shown rotated along pivot 54 towards a diner, stopped by a downwardly angled catch 79, supporting the extension panel 20*b* in its high position. When the extension panel 20*b* is moved to its low position, the securing mechanism 78 is rotated about pivot 53 towards hook 55. The extension panel 20*b* is then moved to its low position about hinge 27 and secured into its low position when hook 76 grips flange 77.

The invention further recognizes that there are a substantial number of single person households. In such a single person situation, eating may most commonly be done at a kitchen counter rather than at a table. The present invention therefore recognizes that the invention apparatus can be built into a counter with a single access cover, a single chute for one-side use, and a pot washer basket mounted so as to travel inwardly and outwardly with respect to only one sidewall. Such a one-sided mechanism could similarly be built into a dining table if desired.

In summary, it will be seen from the foregoing description that the table-dishwasher apparatus of the invention provides among other features the following two highly unique features:

(1) A table-washer apparatus which permits the items being washed, particularly pots and pans, to be loaded into a basket that can be positioned in one position for loading the items being washed and which position is outward of a selected one of opposite sides of the apparatus and can be positioned in another position between said opposite sides for washing the items thereby permitting a diner sitting on either side to use said apparatus; and (2) A table-washer apparatus which permits a diner while sitting on one side of the apparatus to sit below a portion of the table on which the diner dines and simultaneously have access to washing apparatus particularly suited for pots and pans other dishwashing apparatus as well as having access to one or more storage compartments built into the sides of said apparatus.

Other novel features will be apparent from the description.

The above detailed description of a preferred embodiment of the invention is further intended to set forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. Dining apparatus providing a dining table with apparatus for washing items associated with dining, comprising:

(a) an upstanding support base having a top, side walls and end walls;

(b) a horizontally disposed table providing a substantially horizontal dining surface, said table having a middle portion mounted on the top of said support base, end portions overlying and extending outwardly of the support base side walls and within each said end portion an opening bounded by portions of the dining surface;

(c) a dishwasher assembled within the support base and connected to appropriate utilities for operation thereof;

(d) a pair of perforate chutes operatively associated with the dishwasher, each of said chutes being mounted within the support base below a respective one of the openings and configured for receiving and holding a plurality of items to be washed, each chute extending between an open upper end and a closed perforate lower end thereof and being positionable in a first position for loading and unloading and in a second position for washing;

(e) a pair of integral access covers, each cover being formed as a panel operatively associated with a respective opening and mounted in a manner which permits it to be positioned so as to either snugly fill a respective opening and thereby provide a continuation of the dining surface or uncover the respective opening to provide access to a selected one of the dishwasher chutes;

(f) a pot washer assembled into the support base and connected to appropriate utilities for operation thereof;

(g) a perforate pot washer basket operatively associated with the pot washer, mounted within the support base and movable through a slidable connection to a fixed support along a path of restricted length which extends between the side walls of the support base and which path is located below but laterally offset outwardly from being directly below the location of a said opening there above, the pot washer basket being configured for receiving and holding selected pots, pans and the like in position for being washed by the pot washer; and (h) wherein the table end portions, openings, access covers, dishwasher chutes and pot washer basket are arranged so as to be accessible to the apparatus being used by a single individual sitting on either side of said support base, or by two individuals sitting on opposite sides of the support base and in either case in a manner which permits the legs of any such individual when sitting to be positioned below a selected one of the table side portions.

2. A dining apparatus as claimed in claim 1 wherein said first position is angular and said second position is substantially vertical.

3. A dining apparatus as claimed in claim 1 wherein each said opening extends inwardly from the plane occupied by an outer edge of an end portion of said table.

4. A dining apparatus as claimed in claim 1 including for each of said access covers an extension panel mounted thereon and movable between a first position in which said extension panel forms an extension of the dining surface of the respective access cover on which it is mounted and a second position in which said extension panel remains secured to the respective access door but without forming an extension of said dining surface.

5. A dining apparatus as claimed in claim 1 including a positionable door operatively associated with each of the side walls of said support base and located so as to provide access to opposite ends of the pot washer basket.

6. A dining apparatus as claimed in claim 5 including switching means arranged so as to prevent said dish washer and pot washer from operating except when each said positionable door is closed.

7. A dining apparatus as claimed in claim 1 including a first storage compartment extending within said support base from each side wall and formed and located so as to have a central axis which is generally parallel to and laterally offset from the path along which the pot washer basket moves, the lateral offset being sufficient to permit an individual using the apparatus and facing a selected side wall to sit between the location of the first storage compartment and pot washer basket associated with the selected said side wall.

8. A dining apparatus as claimed in claim 1 wherein each said integral access cover comprises a panel formed as a single piece.

9. A dining apparatus as claimed in claim 5 including for each side wall of said support base a storage compartment accessible through a door and being formed and located so as to extend within said support base about an axis which is generally parallel to and laterally offset from the path along which the pot washer basket moves.

10. A dining apparatus as claimed in claim 1 wherein each said dishwasher chute is mounted on rollers to facilitate movement thereof.

11. A dining apparatus as claimed in claim 1 including a control panel mounted on an upper portion of said apparatus in a position accessible to an individual in a wheelchair and including means for controlling both said dish washer and pot washer.

12. A dining apparatus as claimed in claim 1 wherein said slidable connection comprises a slidable connection between said pot washer basket and a pair of elongated rails on which said pot washer basket travels.

13. Dining apparatus providing a dining table with apparatus for washing items associated with dining, comprising:

(a) an upstanding support base having a top, side walls and end walls;

(b) a horizontally disposed table providing a substantially horizontal dining surface, said table having a middle portion centrally mounted on the top of said support base, an end portion overlying and extending outwardly of the support base side walls and within said end portion, an opening extending inwardly from the plane occupied by an outer edge of said table end portions, said opening being bounded by portions of the dining surface and overlying one of said sidewalls;

(c) a dishwasher assembled within the support base and connected to appropriate utilities for operation thereof;

(d) a perforate dishwasher chute operatively associated with the dishwasher, mounted within the support base below the opening and configured for receiving and holding a plurality of the items to be washed, said chute extending downward from an open upper end to a closed perforate lower end thereof and being positionable in a first position for loading and unloading and in a second position for washing;

(e) an access cover formed as a panel operatively associated with said opening and mounted in a manner which permits it to be positioned so as to either snugly fill the opening and thereby provide a continuation of the dining surface or uncover the opening to provide access to the chute;

(f) a pot washer assembled into the support base and connected to appropriate utilities for operation thereof;

(g) a perforate pot washer basket operatively associated with the pot washer, mounted within the support base and movable through a slidable connection to a fixed support along a path of restricted length which extends between the side walls of the support base below but laterally offset outwardly from being directly below the said opening thereabove and which permits an outer end thereof to be positioned outwardly of a side wall through the plane of which said basket travels, said pot washer basket being configured for receiving and holding selected pots, pans and the like in position for being washed by the pot washer; and (h) wherein the table end portions, opening, access cover, dishwasher chute and pot washer basket are arranged so as to be accessible to the apparatus being used by a single individual sitting on one side of said support base and in a manner which permits the legs of any such individual when sitting to be positioned below the table end portion containing said opening.

14. A dining apparatus as claimed in claim 13 wherein said first position is angular and said second position is substantially vertical.

15. Dining apparatus providing a dining table with apparatus for washing items associated with dining, comprising:

(a) an upstanding support base having a top, side walls and end walls;

(b) a horizontally disposed table providing a substantially horizontal dining surface, said table having a middle portion mounted on the top of said support base, end portions overlying and extending outwardly of the support base side walls and within each end portion an opening which extends inwardly from the plane occupied by an outer edge of an end portion of said table and is bounded by portions of the dining surface;

(c) a dishwasher assembled within the support base and connected to appropriate utilities for operation thereof;

(d) a pair of perforate chutes operatively associated with the dishwasher, each of said chutes being mounted within the support base below a respective one of the openings and configured for receiving and holding a plurality of the items, each chute extending downwardly from an open upper end to a closed perforate lower end thereof and being positionable in a first position for loading and unloading through a respective said opening and in a second position for washing;

(e) a pair of integral access covers, each cover being formed as a panel made as a single piece, being operatively associated with a respective opening and mounted in a manner which permits it to be positioned so as to either snugly fill a respective opening and thereby provide a continuation of the dining surface or uncover the respective opening to provide access to a selected one of the dishwasher chutes;

(f) a pot washer assembled into the support base and connected to appropriate utilities for operation thereof;

(g) a perforate pot washer basket operatively associated with the pot washer, slidably mounted on a fixed support within the support base and movable along a path of restricted length which extends between the side walls of the support base below but laterally offset from being directly below the location of an opening thereabove, the pot washer basket being configured for receiving and holding selected pots, pans and the like in position for being washed by the pot washer;

(h) a positionable door on each of the side walls of said support base located so as to provide access to opposite ends of the pot washer basket;

(i) a first pair of storage compartments each of which extends within said support base from a respective side wall and is located so as to have a central axis thereof generally parallel to and laterally offset from the path along which the pot washer basket moves, the lateral offset being sufficient to permit an individual using the apparatus and facing a selected side wall to sit between the location of a first storage compartment located thereon and an outer end of dish washer basket associated with the selected side wall;

(j) a second storage compartment for storing and dispensing a cleaning agent, having a positionable door and located accessible to the user of said apparatus on a selected said end wall;

(k) said access covers and selected ones of the positionable doors having switching means arranged so as to prevent said dishwasher and pot washer from operating unless such selected positionable doors are closed; and (l) wherein the table end portions, openings, access covers, dishwasher chutes, pot washer basket and compartments are arranged so as to be accessible to the apparatus being used by a single individual sitting on either side of said support base, or by two individuals sitting on opposite sides of the support base and in either case in a manner which permits the legs of any such individual when sitting to be positioned below a selected one of the table side portions.

16. A dining apparatus as claimed in claim 15 wherein said first position is angular and said second position is substantially vertical.

17. Dining apparatus providing a dining table with apparatus for washing items associated with dining, comprising:

(a) an upstanding support base having a top, side walls and end walls;

(b) a horizontally disposed table providing a substantially horizontal dining surface, said table having a middle portion mounted on the top of said support base, side portions overlying and extending outwardly of the support base side walls and at least one opening which extends inwardly from the plane occupied by an outer edge of a side portion of said table and is bounded by portions of the dining surface;

(c) a dishwasher assembled within the support base and connected to appropriate utilities for operation thereof;

(d) perforate chute means operatively associated with the dishwasher mounted within the support base below said opening and configured for receiving and holding a plurality of items to be washed, said chute means extending downward from an open upper end to a closed perforate lower end thereof;

(e) access cover means operatively associated with said opening and mounted in a manner which permits said access cover means to be positioned so as to either substantially fill said opening and thereby provide a continuation of the dining surface or uncover said opening to provide access to said perforate chute means;

(f) a pot washer assembled into the support base and connected to appropriate utilities for operation thereof;

(g) a perforate pot washer basket operatively associated with the pot washer, mounted within the support base and movable on a fixed support through a slidable connection along a path of restricted length which as projected extends through the side walls of the support base below but laterally offset from being directly below said opening, the pot washer basket being configured for receiving and holding selected pots, pans and the like in position for being washed by the pot washer; and (h) wherein the table side portions, opening, access cover means, perforate chute means and pot washer basket are arranged so as to be accessible to the apparatus being used by a single individual sitting on either side of said support base, or by two individuals sitting on opposite sides of the support base and in either case in a manner which permits the legs of any such individual when sitting to be positioned below a selected one of the table side portions and for said individual to have access to one end of said pot washer basket.

18. A dining apparatus as claimed in claim 17 including a positionable door on each of the side walls of said support base located so as to provide access to opposite ends of the pot washer basket.

19. A dining apparatus as claimed in claim 18 including a storage compartment extending within said support base from each side wall and formed and located so as to have a central axis which is generally parallel to and laterally offset from the path along which the pot washer basket moves, the lateral offset being sufficient to permit an individual using the apparatus and facing a selected side wall to sit between the location of the storage compartment and pot washer basket associated with the selected side wall.

* * * * *